US009932219B1

(12) United States Patent
Gallagher

(10) Patent No.: US 9,932,219 B1
(45) Date of Patent: Apr. 3, 2018

(54) COUNTER WATER BOTTLE DISPENSER

(71) Applicant: Kenneth John Gallagher, Las Vegas, NV (US)

(72) Inventor: Kenneth John Gallagher, Las Vegas, NV (US)

( * ) Notice: Subject to any disclaimer, the term of this patent is extended or adjusted under 35 U.S.C. 154(b) by 0 days.

(21) Appl. No.: 15/817,185

(22) Filed: Nov. 18, 2017

Related U.S. Application Data

(63) Continuation-in-part of application No. 15/370,075, filed on Dec. 6, 2016, which is a continuation-in-part of application No. 15/155,038, filed on May 15, 2016, now Pat. No. 9,580,290, which is a continuation-in-part of application No. 15/017,613, filed on Feb. 6, 2016, now abandoned.

(60) Provisional application No. 62/548,174, filed on Aug. 21, 2017.

(51) Int. Cl.
*B67D 3/00* (2006.01)

(52) U.S. Cl.
CPC ..... *B67D 3/0032* (2013.01); *B67D 3/0083* (2013.01)

(58) Field of Classification Search
CPC .. B67D 3/0029; B67D 3/0032; B67D 3/0035; B67D 3/0054; B67D 3/008; B67D 3/0083; B67D 3/0087; B67D 3/0061
See application file for complete search history.

(56) References Cited

U.S. PATENT DOCUMENTS 868,439 A * 10/1907 Hyed ..... 222/131
882,552 A * 3/1908 Cordley ..... 165/154
1,009,437 A * 11/1911 Patnaude ..... 165/154
1,142,210 A * 6/1915 Wagner ..... B67D 3/0035 141/330
1,501,068 A * 7/1924 Schatz ..... F25D 3/08 222/129
1,574,495 A * 2/1926 Look ..... B67D 3/0029 222/159
1,591,623 A * 7/1926 Hassensall ..... B67D 3/00 222/146.6
1,658,227 A * 2/1928 Davis, Jr. ..... B67D 3/0029 141/285
1,881,929 A * 10/1932 Pottenger, Jr. ..... B65D 53/02 137/855
1,960,604 A * 5/1934 Van Fleet ..... B67D 3/00 62/171
2,056,863 A 10/1936 Washington
3,843,021 A * 10/1974 Schieser ..... B65D 77/06 222/105
3,848,776 A * 11/1974 Schieser ..... B65D 85/54 222/105
3,974,863 A 8/1976 Frahm
(Continued)

*Primary Examiner* — Patrick M Buechner

(57) ABSTRACT

A walled dispenser base for use with a dispenser for delivering a liquid from an inverted supply bottle. The dispenser has a reservoir container attached to a dispenser valve. The dispenser valve is detached from the walled dispenser base. The dispenser valve extends through a side opening of the walled dispenser base. The walled dispenser base has a top portion where the inverted supply bottle is supported. The walled dispenser base has a rim that has an open section. The side opening extends through the open section of the rim. A foot having a perimeter is formed at a bottom portion of the walled dispenser base. The dispenser valve extends though the side opening and delivers the liquid from the inverted supple bottle beyond the perimeter of the foot.

4 Claims, 6 Drawing Sheets

(56) References Cited

U.S. PATENT DOCUMENTS

| | | | | |
|---|---|---|---|---|
| 4,805,808 | A * | 2/1989 | Larson | B65D 23/10 215/383 |
| 4,972,976 | A | 11/1990 | Romero | |
| 5,431,205 | A | 7/1995 | Gebhard | |
| 5,509,583 | A | 4/1996 | Dolson | |
| 6,085,540 | A * | 7/2000 | Davis | B67D 3/0009 222/190 |
| 6,557,735 | B1 * | 5/2003 | Stray | B67D 3/0029 222/185.1 |
| 9,580,290 | B1 * | 2/2017 | Gallagher | B67D 3/0083 |
| 9,580,292 | B2 | 2/2017 | Smith | |
| 2002/0069664 | A1 * | 6/2002 | Davis | B67D 3/0009 62/392 |
| 2002/0170921 | A1 * | 11/2002 | Tan | B67D 1/1247 222/67 |
| 2010/0314416 | A1 * | 12/2010 | Wezner | A47G 23/0208 222/185.1 |
| 2011/0006078 | A1 * | 1/2011 | Hsu | B67D 3/0009 222/129 |
| 2013/0341355 | A1 | 12/2013 | Weaver | |

* cited by examiner

FIG. 5
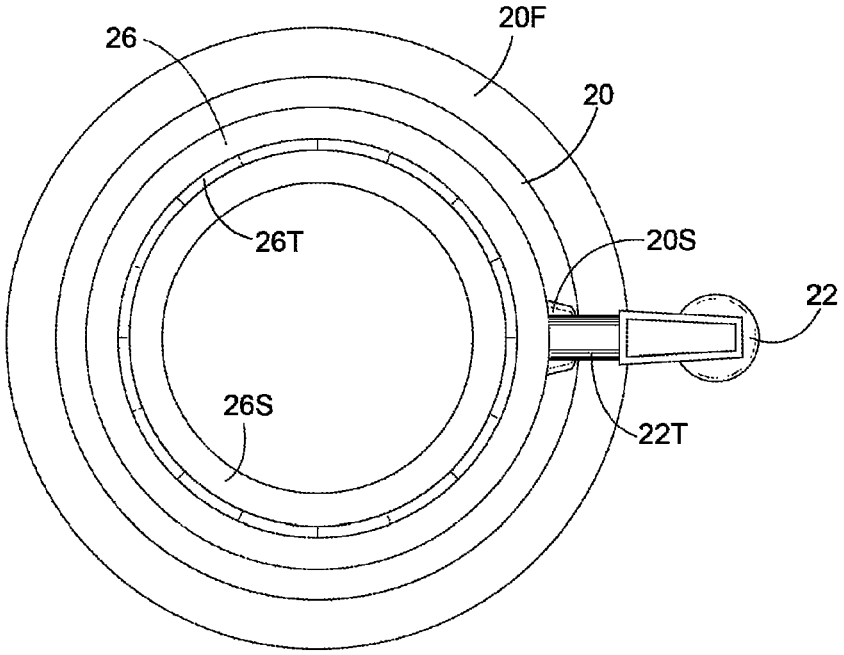
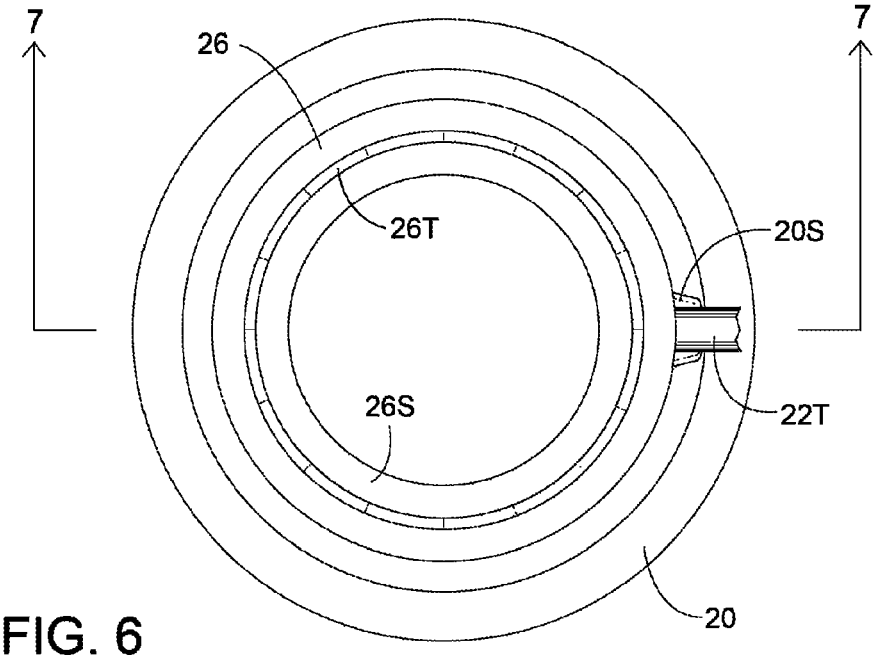
FIG. 6

COUNTER WATER BOTTLE DISPENSER

CROSS REFERENCE TO RELATED APPLICATIONS

The present application is a continuation-in-part of U.S. applicaton Ser. No. 15/370,075 filed on 2016 Dec. 6, entitled "COUNTER WATER BOTTLE DISPENSER" in the name of Kenneth John Gallagher, which is a continuation-in-part of U.S. application Ser. No. 15/155,038, a patented case, filed on 2016 May 15, entitled "COUNTER WATER BOTTLE DISPENSER" in the name of Kenneth John Gallagher, which is a continuation-in-part of U.S. application Ser. No. 15/017,613 filed on 2016 Feb. 6, now abandoned. Additionally, the present application claims the benefit of U.S. Provisional Application No. 62/548,174 filed on 2017 Aug. 21, entitled "COUNTER WATER BOTTLE DISPENSER" in the name of Kenneth John Gallagher. All of the foregoing applications are hereby incorporated herein by reference in their entirety.

BACKGROUND OF THE DISCLOSURE

The present application generally relates to an inverted bottle water dispenser, and more particularly, to water bottle dispensers that provide a convenient and simplified mechanism to access bottled water in a direct manner.

With the advent of increased popularity of bottled spring water and bottled purified water here and abroad, a need may have developed for water bottle dispensers that may provide a convenient and simplified mechanism to access bottled water. Presently, water may be dispensed through a variety of dispensers. One of the most common types of water dispensers is an inverted water bottle dispenser. Currently, most of the inverted water bottle dispensers on the market are designed for use with large reusable water bottles that range in size from 3 to 5 gallons or more. Water bottle dispensers for water bottles in the size range of 3 liters to 2 gallons are not widely used, and there are only a few water bottle dispensers that are designed to use single use water bottles in the 3 liter to 1.5 gallons size. Moreover, the 3 to 5 gallons dispensers may present a number of practical placement and use restrictions and problems. Consequently, there is a need for a countertop and desktop dispenser that may accommodate 3 liter to 1.5 gallon size bottles. However, the current inverted water bottle dispensers on the market may have a reservoir that can grow algae quickly, and the process of cleaning the algae from the reservoirs and the valves of the current dispensers on the market can be quite burdensome, as the dismantling of these dispensers for cleaning can be quite difficult and time consuming. Subsequently, there is a need for an inverted water bottle dispenser wherein a reservoir container and a valve can be easily accessed and cleaned.

Over the years a number of U.S. patents have been issued regarding bottled water dispensers. U.S. Pat. No. 1,009,437 issued to William E. Patnaude illustrates an inverted water bottle dispenser that incorporates a number of valves. A first valve releases water from a cooling chamber filled with ice. A second dispensing valve is attached to a reservoir through the base. The reservoir cannot be removed without removing the valve from the dispenser base. U.S. Pat. No. 1,574,495 issued to Carrol A Look describes a beverage dispenser having a frusto conical base formed in glass integral with an open topped glass formed cup which receives the interverted beverage bottle. A valve is attached to the cup. U.S. Pat. No. 3,974,863 issued to Carl and Shirley Frahm shows a valved water container with seal. The valve is attached to the base. Additionally, the base serves as water container for water dispensed from the inverted water supply bottle. The Frahm water container would be difficult to clean as the water container and base are one and the same. U.S. Pat. No. 4,972,976 issued to Robert A Romero illustrates a dispensing unit for bottled water. The Romero embodiment typical of most inverted water bottle dispensers in that the reservoir is attached to the dispenser valve through the base and the reservoir must be cleaned from the top of the base. U.S. Pat. No. 5,431,205 issued to Albert W. Gebhard describes a dispensing system for bottled liquids. The Gebhard embodiment includes an air entrance port and filter for filtering ambient air that may enter the bottle. The filter could be useful if the dispenser was placed in a garage where filtered air may be desirable. The Gebhard dispenser is just as difficult to clean as the Frahm water container as the reservoir and base are one and the same. U.S. Pat. No. 5,509,583 issued to Chris Dolson illustrates an apparatus for dispensing liquids from a bottle. The upper portion of the stand is partially frusto-conical and partially cylindrical. The lower portion of the stand is frust-conical. A slot extends the entire length of the stand. A valve is connected to the bottle opening and the stand does not contain a reservoir. U.S. Pat. No. 9,580,292 issued to Smith/LaSala shows a dispenser that attaches to a container. A liquid flow pathway of the dispenser may be lowered down into a slot of a pedestal. The liquid flow pathway may rest on the slot of the pedestal for in order to support the valve and the container. With the Smith/LaSala dispenser, the user must attach a valve to a container which may be a difficult task for the user to perform. U.S. Publication 20100314416 of Bryant S. Wezner shows a boxed beverage stand. The Wezner stand has a slotted base for use with a valved box shaped beverage container. However, the Wezner embodiment does not utilize inverted bottles. U.S. Publication 20130341355 of Weaver/Zink embodies a liquid dispensing system. As with the Smith/LaSala dispenser, the Weaver/Zink dispensing system utilizes an inverted bottle and a slotted base. However, as with the dispenser of Smith/LaSala, the user must attach a valve to the bottle which can be a rather cumbersome and difficult task.

SUMMARY OF THE DISCLOSURE

In accordance with one embodiment, a walled dispenser base for use with a dispenser for delivering a liquid from an inverted supply bottle is disclosed. The dispenser has a reservoir container attached to a dispenser valve. The dispenser valve is detached from the walled dispenser base. The dispenser valve extends through a side opening of the walled dispenser base. The inverted supply bottle is supported on a top portion of the walled dispenser base. The walled dispenser base has a rim that has an open section. A side opening is formed in the walled dispenser base. The side opening extends through the open section of the rim. A foot is formed at a bottom portion of the walled dispenser base. The foot has a perimeter. The dispenser valve attached to the reservoir container may be lowered directly downward through the open section of the rim and into the side opening of the walled dispenser base. The dispenser valve delivers the liquid from the inverted supply bottle beyond the perimeter of the foot.

In accordance with one embodiment, a dispenser for delivering a liquid from an inverted supply bottle is disclosed. A walled dispenser base has a top portion where the inverted supply bottle is supported. The walled dispenser base has a rim that has an open section. A side opening is formed in a sidewall of the walled dispenser base. The side opening extends through the open section of the rim. A foot is formed at a bottom portion of the walled dispenser base. A reservoir container rests upon the walled dispenser base. The reservoir container is detached from the walled dispenser base. The reservoir container is detached from the inverted supply bottle. A bottle collar engages a top portion of the walled dispenser base. The bottle collar is adapted to engage the inverted supply bottle positioned on the bottle collar. The bottle collar has a center aperture in a bottle seat where a mouth of the inverted supply bottle extends through. The liquid from the inverted supply bottle is delivered from the mouth of the inverted supply bottle into the reservoir container and through the side opening in the walled dispenser base.

In accordance with one embodiment, a dispenser for delivering a liquid from an inverted supply bottle is disclosed. A walled dispenser base has a top portion where the inverted supply bottle is supported. The walled dispenser base has a rim that has an open section. A side opening is formed in a sidewall of the walled dispenser base. The side opening extends through the open section of the rim. A foot is formed at a bottom portion of the walled dispenser base. A reservoir container rests upon the walled dispenser base. The reservoir container is detached from the walled dispenser base. The reservoir container is detached from the inverted supply bottle. A dispenser valve is attached to the reservoir container. The dispenser valve is separate from the sidewall of the walled dispenser base. A bottle collar engages a top portion of the walled dispenser base. The bottle collar is adapted to engage the inverted supply bottle positioned on the bottle collar. The bottle collar has a center aperture in a bottle seat where a mouth of the inverted supply bottle extends through. The liquid from the inverted supply bottle is delivered from the mouth of the inverted supply bottle into the reservoir container and through the side opening in the walled dispenser base.

BRIEF DESCRIPTION OF THE DRAWINGS

In the descriptions that follow, like parts are marked throughout the specification and drawings with the same numerals, respectively. The drawing figures are not necessarily drawn to scale and certain figures may be shown in exaggerated or generalized form in the interest of clarity and conciseness. The disclosure itself, however, as well as a preferred mode of use, further objectives and advantages thereof, will be best understood by reference to the following detailed description of illustrative embodiments when read in conjunction with the accompanying drawings, wherein:

FIG. 5 is a top view of the exemplary dispenser illustrating a top view of a valve and a valve tube in accordance with one aspect of the present application;

FIG. 6 is a top view of the exemplary dispenser illustrating a broken view of the valve tube in accordance with one aspect of the present application.

DETAILED DESCRIPTION OF THE DISCLOSURE

Figure 1:
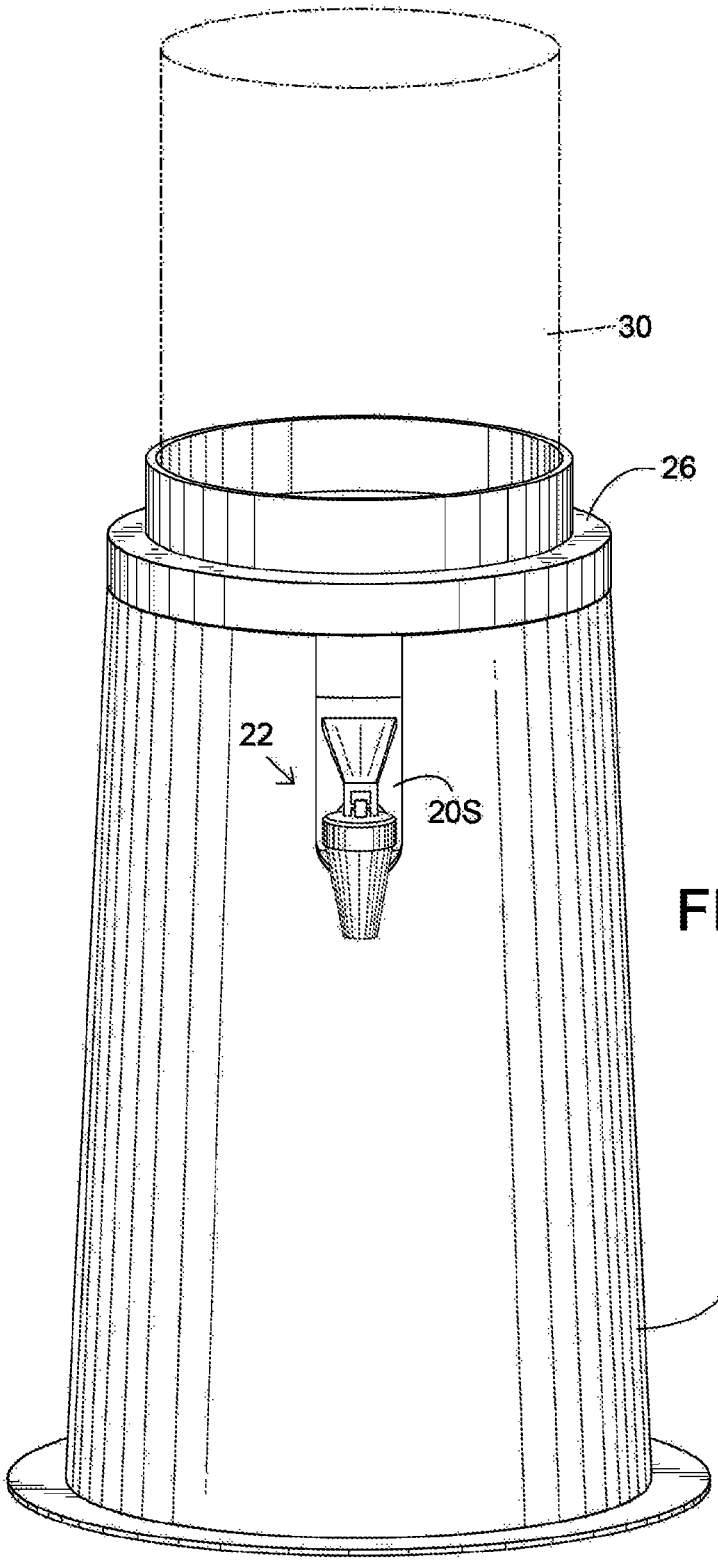
FIG. 1 is a perspective front view of an exemplary water bottle dispenser in accordance with one aspect of the present application.

The description set forth below in connection with the appended drawings is intended as a description of presently preferred embodiments of the disclosure and is not intended to represent the forms in which the present disclosure may be constructed and/or utilized. The description sets forth the functions and the sequence of steps for constructing and operating the disclosure in connection with the illustrated embodiments. It is to be understood, however, that the same or equivalent functions and sequences may be accomplished by different embodiments that also are intended to be encompassed within the spirit and scope of this disclosure.

Accordingly, there are one or more aspects to the present water bottle dispenser that offers advantages over the current existing methods that are being used to serve people water. Embodiments of the disclosure provide a water bottle dispenser that may allow water to be accessed directly from single use water bottles for use with the water bottle dispenser.

In accordance with one embodiment the dispenser may facilitate the cleaning of a reservoir container and a valve of a dispenser. Unlike traditional inverted bottle dispensers, a reservoir container of the applicant dispenser may be easily removed from the dispenser base for cleaning as the reservoir container and a dispensing valve are detached from the dispenser base. The dispenser base may have a side opening in a sidewall of the dispenser base that may extend upward through an open section of a rim of the dispenser base. The side opening in the dispenser base may make it possible to lower the reservoir container with the attached dispenser valve directly downward into the dispenser base, thus the applicant dispenser may eliminate the difficulty of removing and installing a reservoir container and a valve into a dispenser base for the purpose of cleaning.

In accordance with one embodiment, the dispenser may have a bottle collar. The bottle collar may be adapted to accommodate various sizes and shapes of inverted bottles. The bottle collar may have a top enclosure that surrounds a sidewall of an inverted bottle. A bottle collar top enclosure may prevent lateral movement of the inverted bottle when engaged with the bottle collar. The bottle collar may have a bottle seat. The bottle seat may be where the inverted bottle engages the bottle collar. The bottle collar may have a center aperture where the mouth if the inverted supply bottle may extend through.

Additionally, the dispenser may combine a unique dispenser base having a side opening that extends through an open section of a rim of the dispenser base with a reservoir container and attached dispenser valve that may be easily removed from the dispenser base when cleaning may be necessary. And lastly, the dispenser may combine the unique dispenser base together with the reservoir container and the dispenser valve and a bottle collar, the bottle may be adapted to engage a number of bottles of various shapes and sizes.

The above advantages of one or more aspects of the water bottle dispenser will become apparent upon reflection of the disclosure set forth below.

Referring to FIG. 1 a perspective front view of an inverted bottle dispenser may be shown. The dispenser may have a dispenser base 20 (hereinafter base 20). In the present embodiment, the base 20 may be cylindrical in shape. However, only one example may be illustrated, and the base 20 may be offered in a number of other geometrical shapes and sizes. As shown in FIG. 1, the base 20 may be tapered. Thus, a bottom portion of the base 20 may be wider than an upper portion of the base 20. The tapered nature of the base 20 may provide added stability, and may allow for the base 20 to be stacked. Additionally, the base 20 may additionally be formed without a taper. The base 20 may be formed to have a hollow interior. The base 20 may have a removable bottle collar 26 (hereinafter bottle collar 26). The base 20 and the bottle collar 26 may be constructed of a durable plastic such as polypropylene, ABS, or of a metal such as stainless steel. The bottle collar 26 may be removably engaged upon the base 20. The base 20 may be used to support the bottle collar 26 that may be used to house a supply bottle 30 inverted and positioned within the bottle collar 26. A dispenser valve 22 may be view extending through a side opening 20S in the base 20. The dispenser valve 20 may be used to dispense water (hereinafter liquid) from the supply bottle 30.

Figure 2:
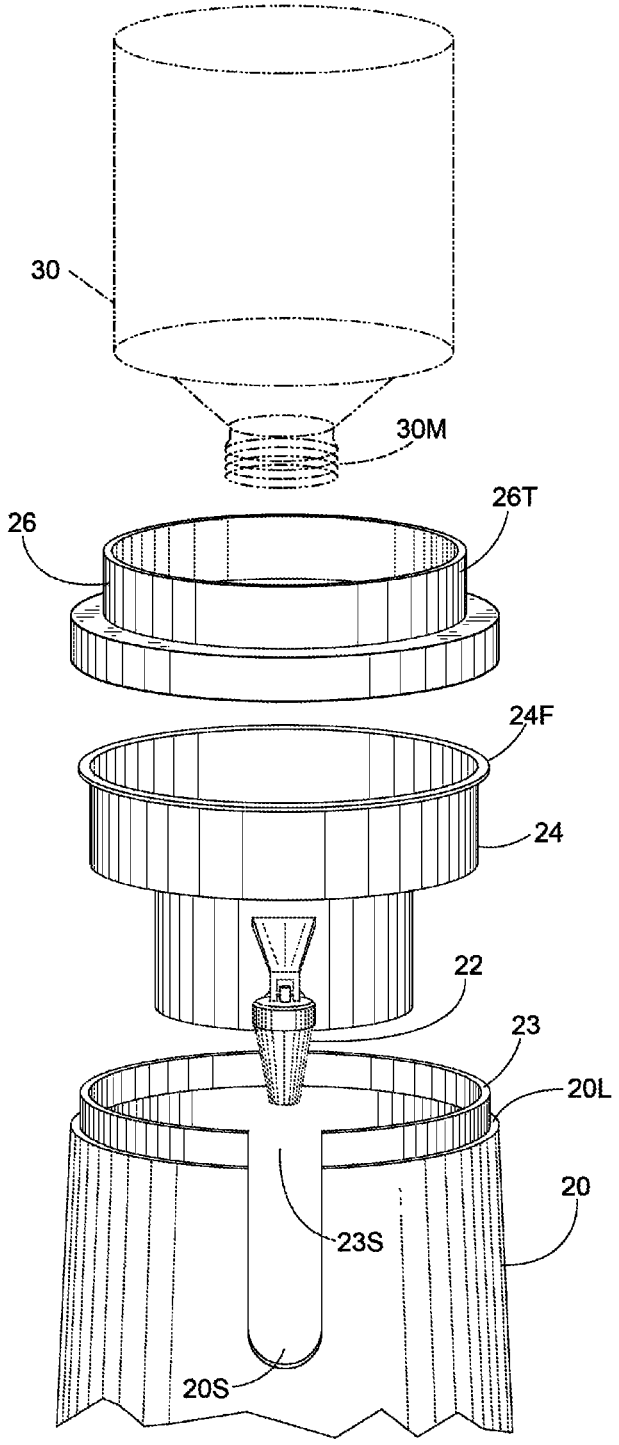
FIG. 2—is an exploded view of the exemplary dispenser of FIG. 1 in accordance with one aspect of the present application.

Referring to FIG. 2, an exploded view of the dispenser of FIG. 1 may be illustrated. A broken view of the dispenser base 20 may be seen at a bottom of FIG. 2. The side opening 20S may be formed in a side of the base 20. A base ledge 20L, and an open section 23S of a rim 23 may be seen located at a top portion of the base 20. The rim 23 of the base 20 may support the reservoir container 24 and the bottle 30 engaged within the bottle collar 26. Moving up, the dispenser valve 22 attached to the reservoir container 24 may be seen. In the present embodiment, the reservoir container 24 may be cylindrical in shape. However, only one example may be illustrated, and the reservoir container 24 may be offered in a number of other geometrical shapes and sizes. The reservoir container 24 may be constructed of a food grade plastic material such as polypropylene or high-density polyethylene or other food grade plastics not mentioned. A reservoir container flange 24F that may engage the rim 23 of the base 20 may also be illustrated. The bottle collar 26 may be seen as located above the reservoir container 24. A top enclosure 26T may surround a portion of a sidewall 30S of the supply bottle 30, and may restrict a lateral movement of the supply bottle 30 while engaged within the bottle collar 26. The bottle collar 26 may be seen located above the reservoir container 24. In the present embodiment, the bottle collar 26 may be rounded in shape. However, only one example may be illustrated, and the bottle collar may be offered in a number of other geometrical shapes and sizes to adapt to different sizes and shapes of inverted bottles. A bottle mouth 30M of the bottle 30 that engages the bottle collar 26 may be shown void of cap and may be seen void of having any attachments.

Figure 3:
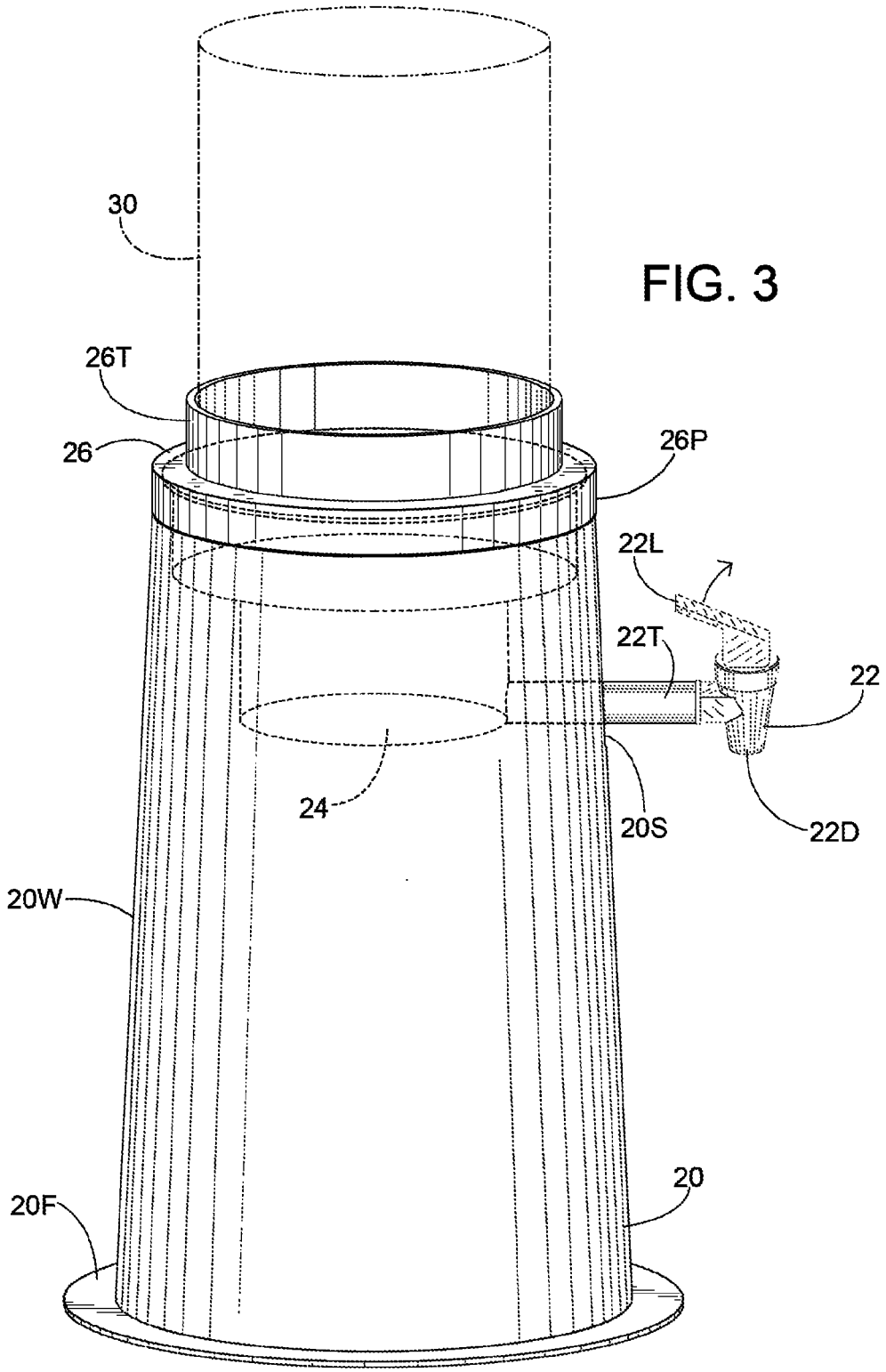
FIG. 3 is a perspective side view of the exemplary water bottle dispenser in accordance with one aspect of the present application.

Referring to FIG. 3 a perspective side view of the inverted bottle dispenser may be shown. A base foot 20F of the base 20 may be seen formed at a bottom portion of the dispenser base. A dispenser tube 22T of the dispenser valve 22 may be seen attached to the reservoir container 24, the reservoir container 24 may be illustrated in dashed lines. The dispenser tube 22T may be shown attached to the reservoir container 24 in dashed lines, and extending through the side opening 20S in a base wall 20W of the base 20. A valve activation lever 22L of the valve 22 may be seen. When the valve activation lever 22L of the valve 22 may be forced forward in the direction of the arrow, the liquid from the inverted supply bottle 30 may pass through the reservoir container 24. The liquid from the supply bottle 30 may be delivered from the reservoir container 24 with the dispenser tube 22T through the side opening 20S to beyond a perimeter of the foot 20F, and then through the valve discharge opening 22D to a location outside the walled dispenser base 20. The bottle 30 may be seen inserted into the top enclosure 26T, and a peripheral portion 26P of the bottle collar 26 may be seen engaging the base 20.

Figure 4:
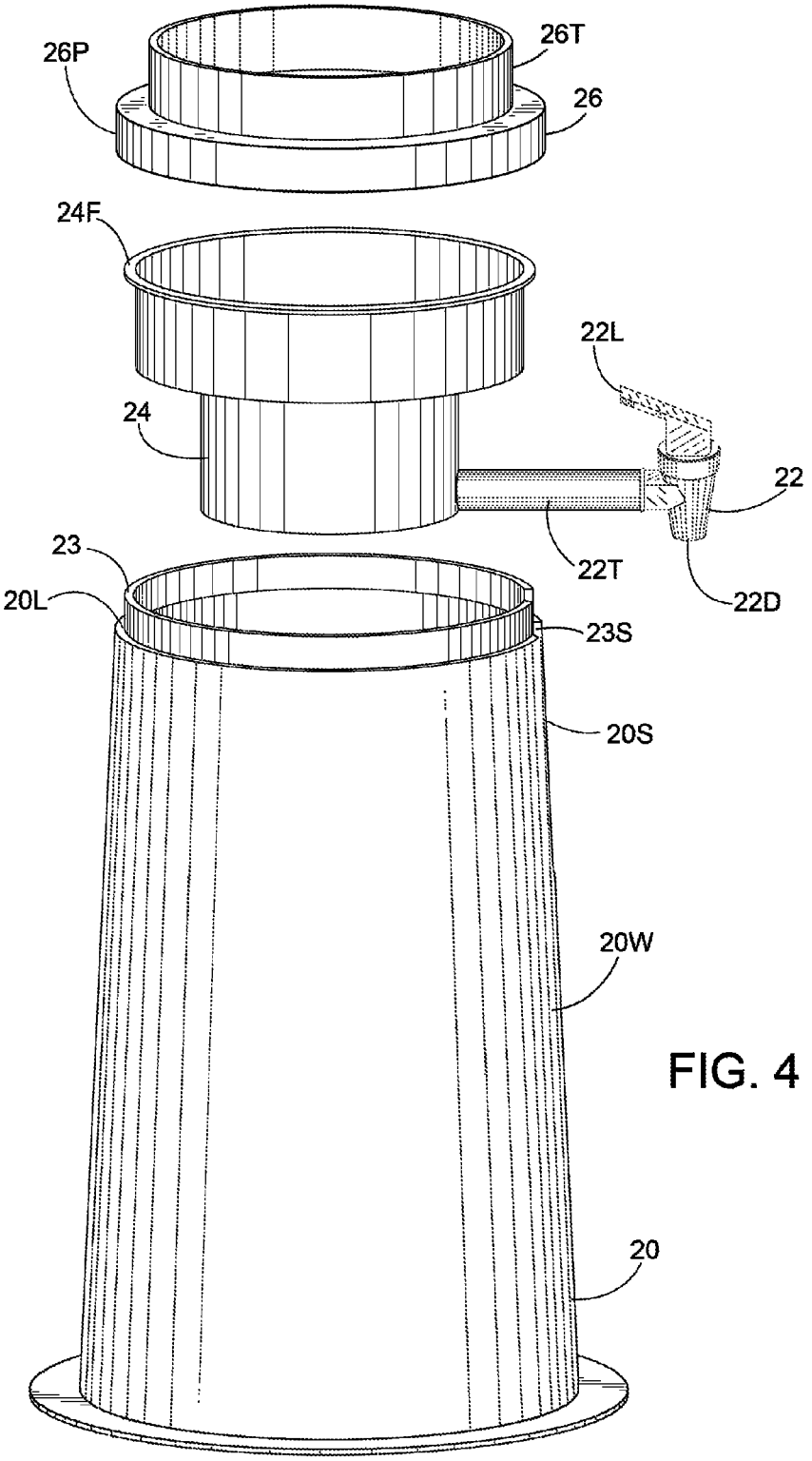
FIG. 4—is an exploded view of the exemplary dispenser of FIG. 3 in accordance with one aspect of the present application.

Referring to FIG. 4, an exploded view of the dispenser of FIG. 3 may be illustrated. The base 20 may be seen at a bottom of FIG. 4. The side opening 20S may be formed in the sidewall 20W of the base 20. The base ledge 20L, and the open section 23S of the rim 23 may be seen. Moving up, the valve activation lever 22L and the valve discharge opening 22D, of the dispenser valve 22 may be illustrated. The dispenser valve 22 may be seen attached to the reservoir container 24 with the valve tube 22T. When installed in the dispenser base 20, the dispenser valve 22 may be detached from the base 20. Additionally, in FIG. 4, the dispenser valve 22 may show a direct injection molded connection to the reservoir container 24 with the valve tube 22T. However, the dispenser valve 22 could also be attached to the reservoir container 24 using a union, a threaded connection, or other means to connect the dispenser valve 22 to the reservoir container 24. The reservoir flange 24F that may engage and rest upon the rim 23 of the base 20 and thus the reservoir container 24 may be detached from the base 20. The bottle 30 may be viewed engaged within the top enclosure 26T of the bottle collar 26, and the peripheral portion 26P of the bottle collar 26 may be seen located above the reservoir container 24.

Referring to FIG. 5, a top view of the dispenser base 20 having the foot 20F may be seen. The top enclosure 26T and a bottle seat 26S, of the bottle collar 26 may be illustrated. The valve tube 22T of the dispenser valve 22 may be viewed extending through the side opening 20S of the dispenser base 20.

Referring to FIG. 6, a top view of the dispenser base 20 may be seen with a broken view of the valve tube 22T extending through the side opening 20S. The top enclosure 26T and the bottle seat 26S, of the bottle collar 26 may be illustrated.

Figure 7:
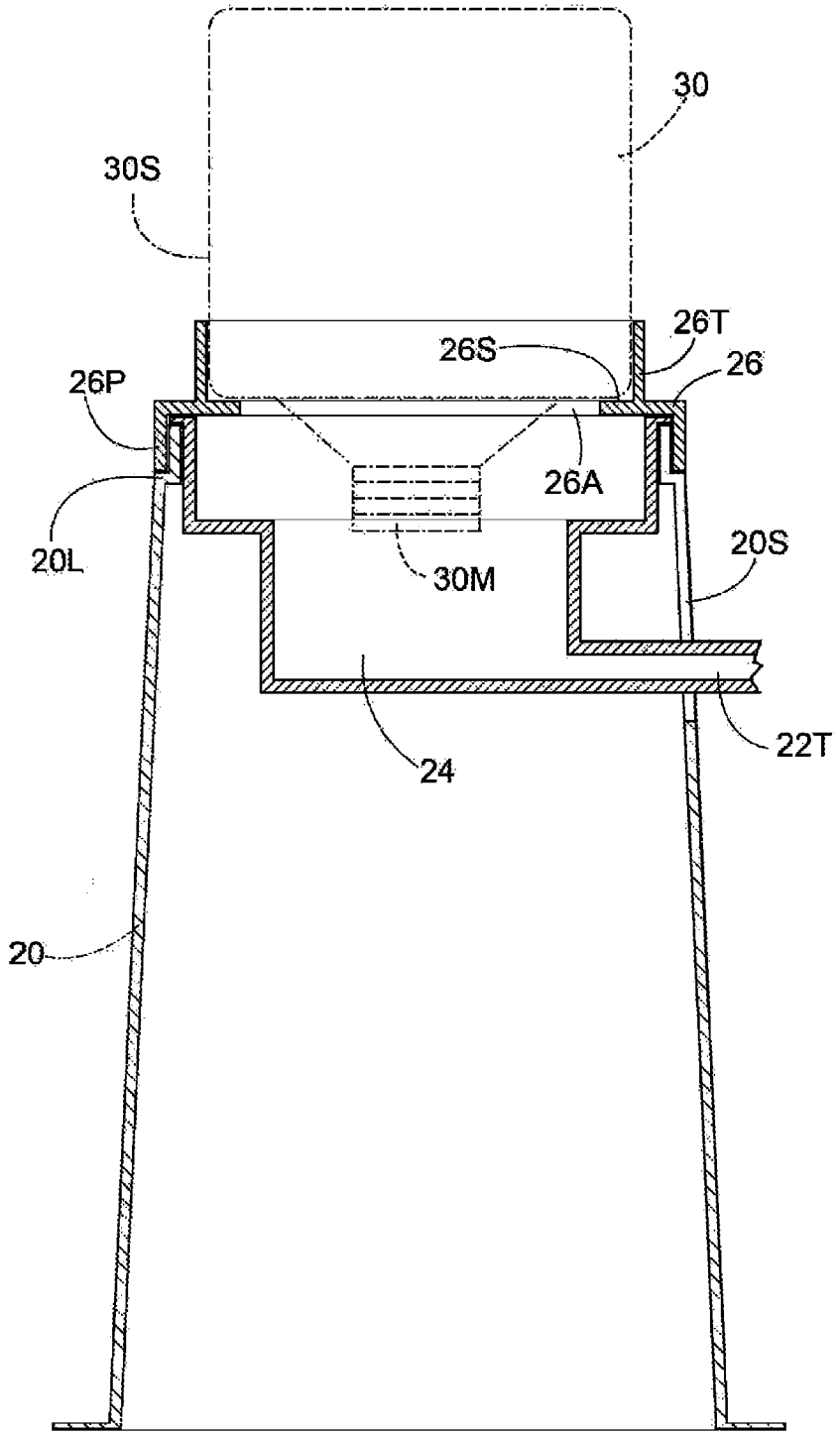
FIG. 7 is a sectional view of FIG. 6 taken at the sectioning plane in the direction indicated by section lines 7-7 in accordance with one aspect of the present application.

Referring to FIG. 7, a sectional view taken at the sectioning plane in the direction indicated by section lines 7-7 of the dispenser base of FIG. 6 may be seen. The bottle 30 may be viewed seated upon the bottle seat 26S, and the sidewall 30S of the bottle 30 may be viewed engaged within the top enclosure 26T of the bottle collar 26. The bottle mouth 30M may be viewed extending through an aperture 26A of the bottle collar 26, and into the reservoir container 24. A broken view of the valve tube 22T that leads to the dispenser valve 22 of FIGS. 3-5 may be illustrated. The peripheral portion 26P of the bottle collar 26 may be seen engaged upon the base ledge 20L, the base ledge 20L located at the top portion of the base 20.

Referring to FIGS. 1-6, the operation and use of the dispenser may now be described. To begin with, the base 20 of the dispenser of FIG. 4 may be placed onto a countertop or desktop. Next, the reservoir container 24 with the attached dispenser valve 22 may be lowered into the base 20 making sure that the valve tube 22T of the dispenser valve 22 is in alignment with the side opening 20S of the base 20. Now the peripheral portion 26P of the bottle collar 26 may be engaged upon the base ledge 20L of the base 20. Lastly, the full supply bottle 30 (FIG. 2) having no cap attached may be quickly inverted so that the liquid from the bottle 30 flows into the reservoir container 24, and the bottle 30 is seated upon the bottle seat 26S within the top enclosure 26T of the bottle collar 26 as seen in FIG. 7. The valve activation lever 22L of the dispenser valve 22 may now be pulled forward in the direction of the arrow as seen in FIG. 3 to dispense the liquid content from the bottle 30.

The dispenser of the present invention may provide numerous advantages. The dispenser may accommodate a variety of commercial water bottles that currently have no additional dispensing methods other than the pouring of the water directly from the bottle mouth of the bottle. The dispenser may provide a reservoir container 24. The reservoir container 24 may be attached to a dispenser valve 22. The reservoir container 24 together with the attached dispenser valve 22 may be easily be removed from the dispenser base 20 for cleaning by lifting the reservoir container 24 upwards so the dispenser valve 22 may be removed from the side opening 20S of the base 20. The inverted bottle 30 may be easily installed into bottle collar 26 of the base 20 by quickly inverting the bottle 30 so the liquid content of the bottle 30 flows into the reservoir container 24 and the bottle 30 is seated upon the bottle seat 26S and within the top enclosure 26T of the bottle collar 26. Additionally, another positive aspect is that with increased usage of the applicant's dispenser the amount of small water bottle sales may be reduced as the dispenser may allow for more "gallon" or larger jugs to be used in households and may lead to an improvement in the environment as the pollution regarding the smaller water bottles may be reduced in quantity.

While embodiments of the disclosure have been described in terms of various specific embodiments, those skilled in the art will recognize that the embodiments of the disclosure may be practiced with modifications within the spirit and scope of the claims. For example, the base could take on additional geometrical shapes/sizes other than the shape of the dispenser base mentioned in the above description. Additionally, other embodiments of the reservoir container not discussed in the above description having different geometrical shapes and sizes may be formed to engage the dispenser base. The dispenser valve could be attached to the reservoir container using means other than a direct connection with the valve tube. The bottle collar could take on additional geometrical shapes and sizes other than the shapes/sizes mentioned in the above description to accommodate a variety of differently shaped and sized bottles. Furthermore, the dispenser could be used with inverted beverage bottles in addition to inverted water bottles. Accordingly, the scope should be determined not by the specific embodiments illustrated, but by the appended claims and their legal equivalents.

DRAWINGS—REFERENCE NUMBERS

20—dispenser base
20F—base foot
20L—base ledge
20S—base side opening
20W—base wall
22—dispenser valve
22L—valve activation lever
22D—valve discharge opening
22T—valve tube
23—base rim
23S—base rim open section
24—reservoir container
24F—reservoir flange
26—bottle collar
26A—bottle collar center aperture
26P—bottle collar peripheral portion
26S—bottle collar bottle seat
26T—bottle collar top enclosure
30—supply bottle
30M—bottle mouth
30S—bottle sidewall

I claim:

1. A walled dispenser base for use with a dispenser for delivering a liquid from an inverted supply bottle, the dispenser having a reservoir container attached to a dispenser valve, the dispenser valve detached from the walled dispenser base and extending though a side opening thereof, the walled dispenser base comprising:

a top portion whereon the inverted supply bottle is supported;

a rim having an open section;

a side opening formed in a side of the walled dispenser base, the side opening extending through the open section of the rim; and a foot formed at a bottom portion of the walled dispenser base, the foot having a perimeter;

whereby the dispenser valve attached to the reservoir container may be lowered directly downward through the open section of the rim and into the side opening of the walled dispenser base, the dispenser valve extending through the side opening in the walled dispenser base and delivering the liquid from the inverted supply bottle beyond the perimeter of the foot.

2. A dispenser for delivering a liquid from an inverted supply bottle comprising:

a walled dispenser base comprising:

a. a top portion whereon the inverted supply bottle is supported;

b. a rim having an open section;

c. a side opening formed in a sidewall of the walled dispenser base, the side opening extending through the open section of the rim;

d. a foot formed at a bottom portion of the walled dispenser base;

a reservoir container, the reservoir container resting upon the top portion of the walled dispenser base, and detached from the inverted supply bottle; and a bottle collar engaging the top portion of walled dispenser base, the bottle collar adapted to engage the inverted supply bottle positioned thereon, the bottle collar having a center aperture in a bottle seat where a mouth of the inverted supply bottle extends therethrough, the liquid from the inverted supply bottle being delivered from the mouth of the inverted supply bottle into the reservoir container and through the side opening in the dispenser base.

3. A dispenser for delivering a liquid from an inverted supply bottle comprising:

a walled dispenser base comprising:

a. a top portion whereon the inverted supply bottle is supported;

b. a rim having an open section;

c. a side opening formed in a sidewall of the walled dispenser base, the side opening extending through the open section of the rim;

d. a foot formed at a bottom portion of the walled dispenser base;

a reservoir container, the reservoir container resting upon the top portion of the walled dispenser base, and detached from the inverted supply bottle;

a dispenser valve attached to the reservoir container, the dispenser valve detached from the sidewall of the walled dispenser base; and a bottle collar engaging the top portion of walled dispenser base, the bottle collar adapted to engage the inverted supply bottle positioned thereon, the bottle collar having a center aperture in a bottle seat where a mouth of the inverted supply bottle extends therethrough, the liquid from the inverted supply bottle being delivered from the mouth of the inverted supply bottle into the reservoir container and through the side opening in the walled dispenser base.

4. A walled dispenser base for use with a reservoir container for delivering a liquid from an inverted supply bottle, the reservoir container resting upon the dispenser base, detached from the inverted supply bottle, and having an attached dispenser valve, the dispenser valve detached from a sidewall of the walled dispenser base, the walled dispenser base comprising:

a top portion whereon the inverted supply bottle is supported;

a rim having an open section;

a side opening formed in the walled dispenser base, the side opening extending through the open section of the rim;

a foot formed at a bottom portion of the dispenser base;

whereby the dispenser valve attached to the reservoir container may be lowered directly downward through the open section of the rim and into the side opening of the walled dispenser base, the dispenser valve delivering the liquid from the inverted supply bottle to a location beyond the side opening.

* * * * *